United States Patent [19]

Ono et al.

[11] Patent Number: 4,610,959

[45] Date of Patent: Sep. 9, 1986

[54] DIRECT POSITIVE SILVER HALIDE PHOTOGRAPHIC MATERIALS

[75] Inventors: Shigetoshi Ono; Shigeru Nakamura; Kazuhiko Matsumoto, all of Kanagawa, Japan

[73] Assignee: Fuji Photo Film Co., Ltd., Kanagawa, Japan

[21] Appl. No.: 703,575

[22] Filed: Feb. 20, 1985

[30] Foreign Application Priority Data

Feb. 20, 1984 [JP] Japan ..... 59-29940

[51] Int. Cl.[4] ..... G03C 5/24

[52] U.S. Cl. ..... 430/598; 430/505; 430/547; 430/955; 430/940; 430/217; 430/218; 430/410

[58] Field of Search ..... 430/940, 598, 551, 547, 430/550, 505, 955, 217, 218, 410

[56] References Cited

U.S. PATENT DOCUMENTS 4,341,858 7/1982 Chaffee et al. ..... 430/598
4,431,730 2/1984 Urabe et al. ..... 430/940
4,478,928 10/1984 Hess et al. ..... 430/598

FOREIGN PATENT DOCUMENTS 530180 9/1956 Canada ..... 430/598

OTHER PUBLICATIONS

Research Disclosure 23510, Nov. 1983.
Research Disclosure 15162, Nov. 1976.

*Primary Examiner*—Won H. Louie
*Attorney, Agent, or Firm*—Sughrue, Mion, Zinn, Macpeak and Seas

[57] ABSTRACT

A direct positive silver halide photographic material is described, comprising a support having thereon at least an internal latent image-type direct positive silver halide emulsion layer containing a hydrazine series nucleating agent, wherein said silver halide emulsion layer or a layer adjacent to the silver halide emulsion layer contains a non-dye image-forming compound represented by following general formula (I) in an amount sufficient for accelerating nucleation;

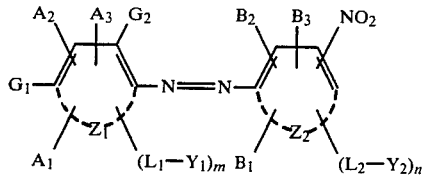

(I)

wherein $Z_1$ and $Z_2$, which may be the same or different, each represents an atomic group necessary for forming a benzene ring or a naphthalene ring; $G_1$ and $G_2$, which may be the same or different, each represents hydrogen or a substituent which does not adversely influence the image; $A_1$, $A_2$ and $A_3$, which may be the same or different, each represents hydrogen or a substituent which does not adversely influence the image; $B_1$, $B_2$ and $B_3$, which may be the same or different, each represents hydrogen or a substituent which does not adversely influence the image, $L_1$ and $L_2$, which may be the same or different, each represents a linkage group; m and n represent 0 or 1; and $Y_1$ and $Y_2$, which may be the same or different, each represents a hydrogen atom or a component having a function of releasing an azo compound from general formula (I) as the result of development.

26 Claims, No Drawings

DIRECT POSITIVE SILVER HALIDE PHOTOGRAPHIC MATERIALS

FIELD OF THE INVENTION

This invention relates to a photographic material having internal latent image-type direct positive silver halide emulsion layers. More particularly, the invention relates to the aforesaid photographic material containing a novel azo compound which acts as a nucleation accelerator.

BACKGROUND OF THE INVENTION

In obtaining a direct positive image using internal latent image type silver halide emulsions, it is effective to use a hydrazine series compound as a nucleating agent and described in, for example, U.S. Pat. No. 4,341,858 and T. H. James, *The Theory of the Photographic Process;* 4th edition, published by Macmillan Publishers Co., Inc., New York, 1977.

It is known that in a photographic material comprising a support having a low oxygen permeability such as, in particular, a polyester support having coated thereon an internal latent image-type direct positive silver halide emulsion layer, a sufficient image density is not obtained since the nucleating action of the hydrazine compound contained therein in insufficient.

In order to overcome this difficulty, the following methods have been proposed: a method of using a strong oxidizing agent such as a ferricyanide compound for the silver halide emulsion layers as described in *Research Disclosure,* No. 16929 (1978) and No. 16936 (1978) and a method of using a quinone oxidizing agent for the silver halide emulsion layers as described in the above-described U.S. Pat. No. 4,341,858.

However, the former method results in the problems of deficiency in maximum density and the formation of stain and the latter method results in the problem of the formation of stain in the minimum density portions.

SUMMARY OF THE INVENTION

An object of this invention is, therefore, to provide a novel nucleation accelerator capable of providing the maximum density having a desired density for a photograph and preventing the formation of stains in the minimum density portions.

Another object of this invention is to provide an internal latent image-type direct positive silver halide photographic material containing such a nucleation accelerator.

As a result of various investigations, the inventors have discovered that the above-described objects are effectively attained by a direct positive silver halide photographic material comprising a support having thereon at least one internal latent image-type direct positive emulsion layer containing a hydrazine series nucleating agent, wherein said emulsion layer or a layer adjacent to the emulsion layer contains a non-dye image-forming compound represented by following general formula (I) in an amount sufficient for accelerating nucleation;

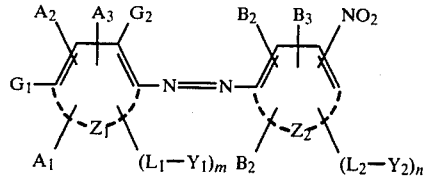

(I)

wherein $Z_1$ and $Z_2$, which may be the same or different, each represents an atomic group necessary for forming a benzene ring or a naphthalene ring; $G_1$ and $G_2$, which may be the same or different, each represents hydrogen or a substituent which does not adversely influence the image; $A_1$, $A_2$ and $A_3$, which may be the same or different, each represents hydrogen or a substituent which does not adversely influence the image; $B_1$, $B_2$ and $B_3$, which may be the same or different, each represents hydrogen or a substituent which does not adversely influence the image; $L_1$ and $L_2$, which may be the same or different, each represents a linkage group; m and n represents 0 or 1; and $Y_1$ and $Y_2$, which may be the same or different, each represents hydrogen or a component having a function of releasing an azo compound from general formula (I) as the result of development by heat or an alkaline processing liquid.

It has been found that by the present invention, the above-described objects can be attained and photographic images stable to heat and humidity are obtained.

DESCRIPTION OF THE PREFERRED EMBODIMENT

Examples of the substituent shown by $G_1$, $G_2$, $A_1$, $A_2$, $A_3$, $B_1$, $B_2$ and $B_3$ in general formula (I) which do not adversely influence the image are a halogen atom, a nitro group, a cyano group, an alkyl group, a substituted alkyl group, an alkoxy group, a substituted alkoxy group, a group shown by —$NHCOR^1$ (wherein $R^1$ represents an alkyl group, a substituted alkyl group, a phenyl group, a substituted phenyl group, an aralkyl group, or a substituted aralkyl group), a group shown by —$NHSO_2R^1$ (wherein $R^1$ is as defined above), a group shown by —$SOR^1$ (wherein $R^1$ is as defined above), a group shown by —$SO_2R^1$ (wherein $R^1$ is as defined above), a group shown by —$COR^1$ (wherein $R^1$ is as defined above), a group shown by

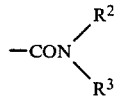

(wherein $R^2$ and $R^3$, which may be the same or different, each represents hydrogen, an alkyl group, a substituted alkyl group, a phenyl group, a substituted phenyl group, an aralkyl group, or a substituted aralkyl group), a group shown by

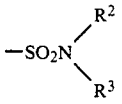

(wherein $R^2$ and $R^3$ are as defined above), an amino group which may be substituted by an alkyl group, or a group forming a hydroxy group by hydrolysis.

Examples of the substituent for the above-described substituted alkyl group, substituted alkoxy group, substituted phenyl group and substituted aralkyl group are an amino group, a hydroxy group, a nitro group, an alkoxy group having 1 to about 4 carbon atoms, a group shown by $-NHSO_2R^1$ (wherein $R^1$ is as defined above), a group shown by $-NHCOR^1$ (wherein $R^1$ is as defined above), a group shown by

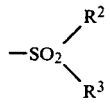

(wherein $R^2$ and $R^3$ are as defined above), a group shown by

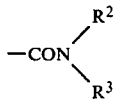

(wherein $R^2$ and $R^3$ are as defined above), a group shown by $-SO_2R^1$ (wherein $R^1$ is as defined above), a group shown by $-COR^1$ (wherein $R^1$ is as defined above), a halogen atom, a cyano group, an amino group, which may be substituted by an alkyl group, etc.

The linkage group shown by $L_1$ and $L_2$ is shown by $-J_1\text{-}X_2-J_2\text{-}X_2)_p(J_3\text{-}X_3)_q]_r$ (wherein $J_1$, $J_2$ and $J_3$, which may be the same or different, each represents —CO—, $-SO_2-$,

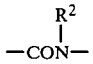

(wherein $R^2$ is as defined above),

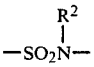

(wherein $R^2$ is as defined above),

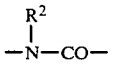

(wherein $R^2$ is as defined above),

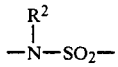

(wherein $R^2$ is as defined above),

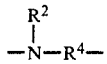

(wherein $R^2$ is as defined above and $R^4$ represents an alkylene group having 1 to about 4 carbon atoms),

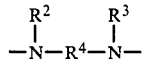

(wherein $R^2$, $R^3$ and $R^4$ are as defined above), —O—, —S—,

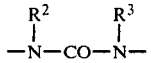

(wherein $R^2$ and $R^3$ are as defined above),

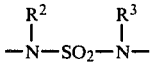

(wherein $R^2$ and $R^3$ are as defined above), etc.; and $X_1$, $X_2$ and $X_3$, which may be the same or different, each represents an alkylene group, a substituted alkylene group, an arylene group, a substituted arylene group, an aralkylene group, or a substituted aralkylene group.

As the substituent of these substituted alkylene group, substituted arylene group, and substituted aralkylene group, there are the atoms and the groups as illustrated above. Also, p, q and r in the above formula each represent 0 or 1.

In the compounds shown by general formula (I), the following cases are preferred.

$Z_1$ and $Z_2$ of general formula (I), which may be the same or different, each represents an atomic group necessary for forming a benzene ring or a naphthalene ring.

At least one of $G_1$ and $G_2$ represents an electron attractive atom or group having a Hammet's $\sigma$ value higher than that of a fluorine atom with specific examples being a fluorine atom, a chlorine atom, a bromine atom, an iodine atom, a nitro group, a cyano group, an alkylsulfonyl group a sulfamoyl group, a sulfonamido group, a carbamoyl group, etc. The Hammet's $\sigma$ value is described in, for example, *J. Org. Chem.*, Vol. 23, 420 (1958). When only one of $G_1$ and $G_2$ is the above-described electron attractive atom or group, the other one represents hydrogen, a halogen atom, an alkyl group, an alkoxy group, a cyano group, a nitro group, $-SO_2R^1$ (wherein $R^1$ is as defined above), $-NHCOR^1$ (wherein $R^1$ is as defined above), $-NHSO_2R^1$ (wherein $R^1$ is as defined above),

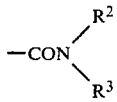

(wherein $R^2$ and $R^3$ are as defined above), or

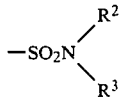

(wherein $R^2$ and $R^3$ are as defined above).

$A^1$, $A^2$ and $A^3$, which may be the same or different, each represents hydrogen, an alkyl group, a halogen atom, a cyano group, $-NHCOR^1$ (wherein $R^1$ is as defined above), $-NHSO_2R^1$ (wherein $R^1$ is as defined above), $-SO_2R^1$ (wherein $R^1$ is as defined above),

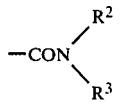

(wherein $R^2$ and $R^3$ are as defined above), or

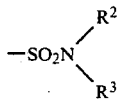

($R^2$ and $R^3$ are as defined above).

$B_1$, $B_2$, and $B_3$, which may be the same or different, each represents hydrogen, a halogen atom, a nitro group, a cyano group, an alkyl group, an alkoxy group, $—SO_2R^1$ (wherein $R^1$ is as defined above),

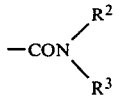

(wherein $R^2$ and $R^3$ are as defined above), or

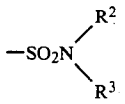

(wherein $R^2$ and $R^3$ are as defined above).

$J_1$, $J_2$ and $J_3$, which may be the same or different, each represents —CO—, $—SO_2—$, —CONH—, $—SO_2NH—$, —NHCO—, or $—NHSO_2—$.

$X_1$, $X_2$, and $X_3$, which may be the same or different, each represents an alkylene group, an arylene group or a substituted arylene group.

Also, p, q and r in general formula (I) represent 0 or 1.

In the compounds shown by general formula (I), the following case is particularly preferred:

That is, $Z_1$ in general formula (I) represents an atomic group necessary for forming a benzene ring or a naphthalene ring and $Z_2$ represents an atomic group necessary for forming a benzene ring.

At least one of $G_1$ and $G_2$ is a halogen atom (particularly, a chlorine atom) and when only one of $G_1$ and $G_2$ is a halogen atom, the other one is hydrogen, an alkyl group or an alkoxy group.

$A_1$, $A_2$, and $A_3$, which may be the same or different, each represents hydrogen, a halogen atom, an alkyl group, a cyano group, $—NHCOR^5$ (wherein $R^5$ represents an alkyl group or a phenyl group), $—NHSO_2R^5$ (wherein $R^5$ is as defined above)

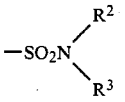

(wherein $R^2$ and $R^3$ are as defined above), or

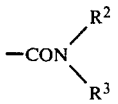

(wherein $R^2$ and $R^3$ are as defined above).

$B_1$, $B_2$, and $B_3$, which may be the same or different, each represents hydrogen, a cyano group, a halogen atom, a nitro group, an alkyl group, $—SO_2R^5$ (wherein $R^5$ is as defined above),

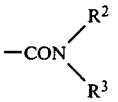

($R^2$ and $R^3$ are as defined above), or

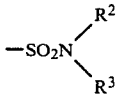

(wherein $R^2$ and $R^3$ are as defined above).

$J_1$ and $J_2$, which may be the same or different, each represents —CO—, $—SO_2—$, —CONH—, $—SO_2NH—$, —NHCO—, or $—NHSO_2—$.

$X_1$ and $X_2$, which may be the same or different, each represents a phenylene group, a substituted phenylene group or an alkylene group.

Also, p and r represent 0 or 1 and q represents 0.

Furthermore, it is particularly preferred that the nitro group substituted to the benzene ring completed by $Z_1$ and $Z_2$ is disposed at the p-position or the o-position to an azo group.

A specific example of the group of $Y_1$ and $Y_2$ other than hydrogen is the group shown by (Ballast)(redox cleavage atomic group—.

(Ballast—is a group for substantially immobilizing the compound of this invention shown by general formula (I) in photographic layers of photographic materials.

Specific examples of the (Ballast—which can be employed in this invention are described in col. 7, line 41 to col. 18, line 68 of U.S. Pat. No. 4,245,028.

—Redox cleavage atomic group—has a property of being cleaved by oxidation or reduction by the action of heat or under an alkaline condition or a property of ring-closure to release the azo compound portion bonded thereto.

Examples of the effective redox cleavage atomic group are described in, for example, U.S. Pat. Nos. 3,928,312; 3,993,638; 4,076,529; 4,152,153, 4,055,428; 4,053,312; 4,198,235; 4,179,291; 4,149,892; 3,844,785; 3,443,943; 3,751,406; 3,443,939; 3,443,940; 3,628,952; 3,980,479; 4,183,753, 4,142,891; 4,278,750, 4,139,379; 4,218,368; 3,421,964; 4,199,355; 4,199,354; 4,278,750, 4,135,929; 4,336,322; 4,371,604; and 4,139,389; Japanese Patent Application (OPI) Nos. 50736/78; 4819/77; 104343/76; 130122/79; 110827/78; 12642/81; 16131/81; 4043/82; 650/82; 20735/82; 69033/78; 130927/79; 164342/81; 119345/82, etc. (The term "OPI" described above indicates an unexamined published patent application open to public inspection.)

Specific examples of these groups are N-substituted sulfamoyl groups.

Now, specific examples of the compound shown by general formula (I) described above are as follows.

Compound 1: The compound of the formula:

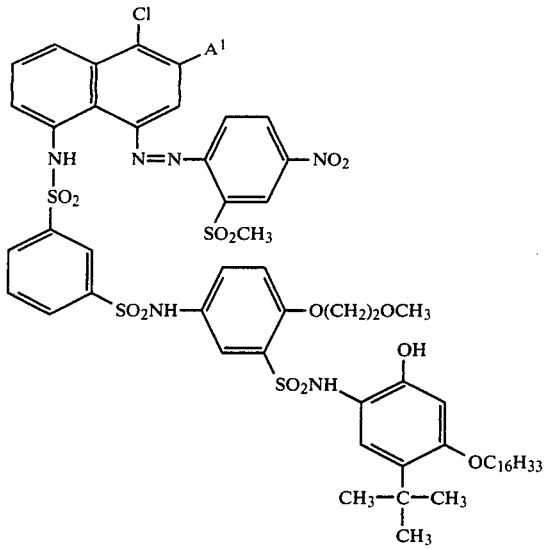

wherein $A^1$ is H.

Compound 2: The compound shown by the formula showing Compound 1, wherein $A^1$ is Cl.

Compound 3: The compound shown by the formula showing Compound 1, wherein $A^1$ is $—NHCOCH_3$.

Compound 4: The compound shown by the formula showing Compound 1, wherein $A^1$ is $—NHSO_2CH_3$.

Compound 5: The compound shown by the formula showing Compound 1, wherein $A^1$ is —CN.

Compound 6: The compound shown by the formula showing Compound 1, wherein $A^1$ is $—SO_2N-(iso—C_3H_7)_2$.

Compound 7: The compound shown by the formula showing Compound 1, wherein $A^1$ is $—CON(C_2H_5)_2$.

Compound 8: The compound of the formula:

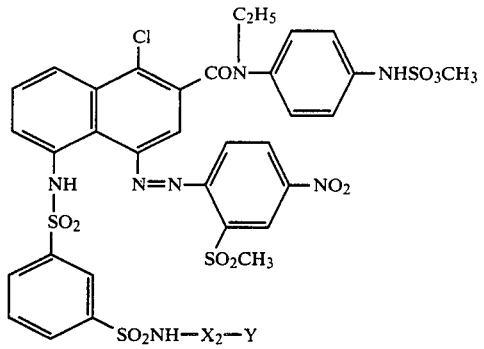

wherein $X_2$ is

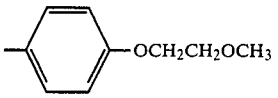

Y is

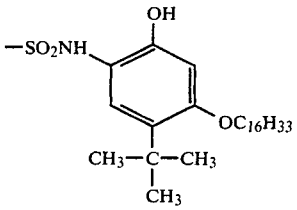

Compound 9: The compound shown by the formula showing Compound 8, wherein $X_2$ is $—C_{16}H_{32}—$ and Y is H.

Compound 10: The compound of the formula:

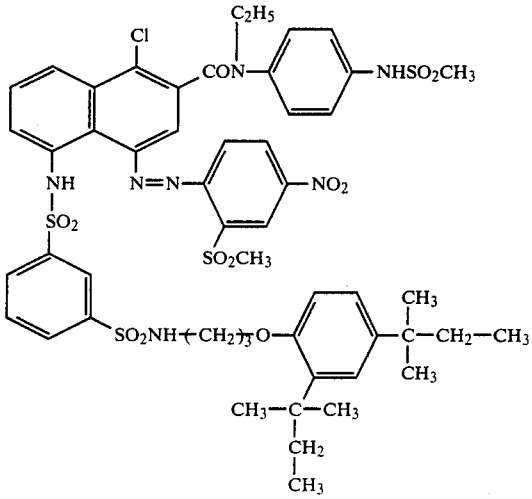

Compound 11: The compound of the formula:

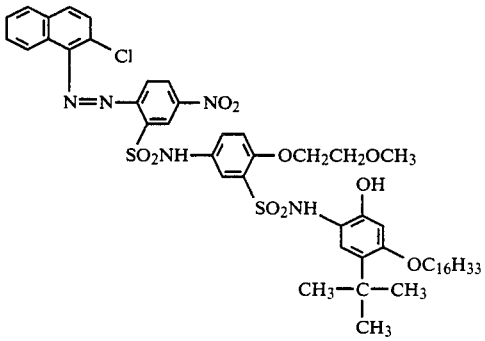

Compound 12: The compound of the formula:

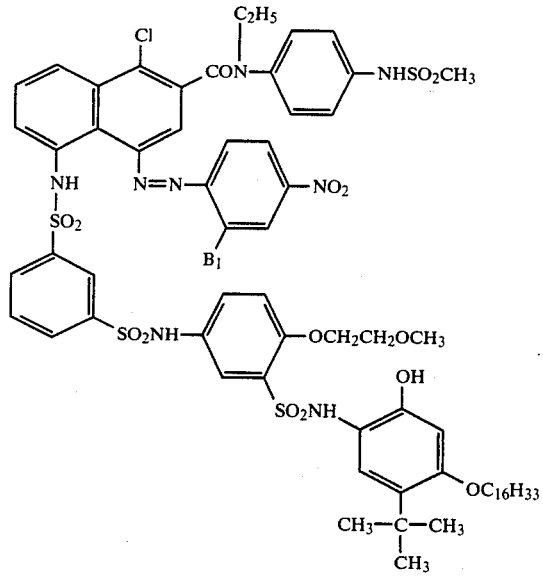

wherein $B_1$ is H.

Compound 13: The compound shown by the formula showing Compound 12, wherein $B_1$ is —$NO_2$.

Compound 14: The compound shown by the formula showing Compound 12, wherein $B_1$ is —Cl.

Compound 15: The compound shown by the formula showing Compound 12, wherein $B_1$ is —CN.

Compound 16: The compound shown by the formula showing Compound 12, wherein $B_1$ is —Br.

Compound 17: The compound of the formula:

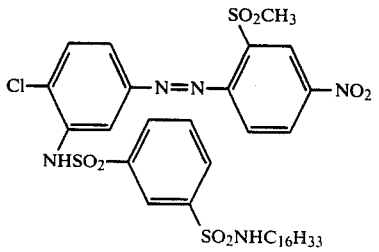

Compound 18: The compound of the formula

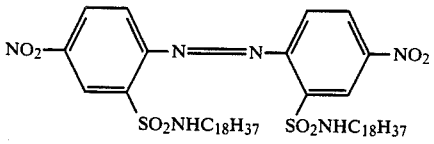

Then, examples of preparing several compounds of general formula (I) are illustrated below.

SYNTHESIS EXAMPLE 1

Synthesis of Compound 1

(1) Synthesis of 1-chloro-5-(3-chlorosulfonylbenzenesulfonamido)-4-(2-methanesulfonyl-4-nitrophenylazo)naphthalene:

A mixture of 50 ml of 5-(3-chlorosulfonylbenzenesulfonamido)-4-(2-methanesulfonyl-4-nitrophenylazo)-1-naphthol and 20 ml of phosphorus oxychloride was refluxed on a steam bath for 2 hours. After cooling, 500 ml of ice-water was added to the reaction mixture and the product was collected by filtration and washed with water to provide 9.3 g of the desired compound.

(2) Synthesis of Compound 1

A mixture of 9.3 g of the desired compound obtained in foregoing step (1), 5.5 g of 2-[3-amino-6-(2-methoxyethoxy)benzenesulfonamido]-4-tert-butyl-5-hexadecyloxyphenol, 50 ml of N,N-dimethylacetamide, and 2.3 ml of pyridine was stirred for 30 minutes at room temperature and the reaction product thus obtained was added to dilute hydrochloric acid (5 ml of hydrochloric acid and 400 ml of water). After filtering, the product thus collected was treated by column using chloroform as a development solvent to obtain 3.2 g of Compound 1.

SYNTHESIS EXAMPLE 2

Synthesis of Compound 8

A mixture of 8.6 g of 1-chloro-5-(3-chlorosulfonylbenzenesulfonamido)-2-N-ethyl-N-(4-methanesulfonamidophenyl)carbamoyl-4-(2-methanesulfonyl-4-nitrophenylazo)naphthalene, 6.3 g of 2-[3-amino-6-(2-methoxyethoxy)benzenesulfonamido]-4-tert-butyl-5-hexadecyloxyphenol, 50 ml of N,N-dimethylacetamide, and 2 ml of pyridine was stirred for 30 minutes at room temperature. After adding the reaction product thus obtained to an aqueous hydrochloric acid solution (5 ml of hydrochloric acid and 400 ml of water), the reaction product was collected by filtration. The product was subjected to a column treatment using chloroform as a development solvent to obtain 1.3 g of the desired product.

SYNTHESIS EXAMPLE 3

Synthesis of Compound 10

A mixture of 10 g of 1-chloro-5-(3-chlorosulfonylbenzenesulfonamido)-2-N-ethyl-N-(4-methanesulfonamidophenyl)carbamoyl-4-(2-methanesulfonyl-4-nitrophenylazo)naphthalene, 2.9 g of 1-aminopropoxy-2,4-di-tert-amylbenzene, 50 ml of N,N-dimethylacetamide, and 2 ml of triethylamine was stirred for 30 minutes at room temperature. After adding the reaction product thus obtained to an aqueous hydrochloric acid solution (5 ml of hydrochloric acid and 400 ml of water), the reaction product was collected by filtration and subjected to a column treatment using a mixture of ethyl acetate and chloroform as a development solvent to obtain 1.1 g of the desired compound.

The compound of general formula (I) may be incorporated in the silver halide emulsion layer containing a hydrazine series nucleating agent or a layer adjacent to the silver halide emulsion layer in the silver halide photographic material, but is preferably incorporated in the layer adjacent to the silver halide emulsion layer. Such a layer adjacent to the silver halide emulsion layer includes a layer containing a dye-image forming compound (hereinafter, is referred to as coloring material) or a so-called interlayer disposed between the silver halide emulsion layer and an other silver halide emulsion layer. It is particularly preferred that the foregoing compound is incorporated in a layer disposed between the above-described silver halide emulsion layer and a layer containing a coloring material. Also, it is most preferred that the compound be incorporated in a layer adjacent to the silver halide emulsion layer disposed at the farthest position from the side to which a processing liquid is spread.

The amount of the compound of general formula (I) is an amount necessary and sufficient for accelerating nucleation. Practically, the amount of the compound is far smaller than the addition amount of an azo compound as a coloring material for the color photographic material, that is the amount is properly less than about 0.1 millimole/$m^2$ (about 0.0005 to about 0.1 millimole/$m^2$), preferably about 0.001 to about 0.05 millimole/$m^2$, more particularly about 0.004 to about 0.2 millimole/$m^2$. Since the addition amount of the compound is very small as described above, the compound is substantially colorless in a photographic layer and does not form dye images after development.

The azo compound of this invention can be dispersed in a hydrophilic colloid which is a binder by various methods according to the type of the compound. For example, the compound having a dissociating group such as a sulfo group or a carboxy group is dissolved in water or an alkaline aqueous solution and then the solution is dispersed in an aqueous hydrophilic colloid solution. On the other hand, when the compound is sparingly soluble in an aqueous medium and is soluble in an organic solvent, the compound can be dispersed in an aqueous hydrophilic colloid solution by the following manner.

(1) A method of dispersing a solution of the compound dissolved in a substantially water-insoluble high-boiling organic solvent in an aqueous hydrophilic colloid solution. This method is described in, for example, U.S. Pat. Nos. 2,322,027; 2,533,514; and 2,801,171. Also, if necessary, a low-boiling solvent or an organic solvent capable of easily dissolving in water may be used in this case and such a solvent is removed by volatilization by drying or by water washing.

(2) A method of dissolving the compound in a water-miscible solvent and dispersing in a hydrophilic colloid solution as the solution. This method is described in, for example, Japanese Patent Application (OPI) No. 138726/78.

(3) A method of using a hydrophilic polymer in place of or together with the high-boiling solvent in foregoing method (1). This method is described in, for example, U.S. Pat. No. 3,619,195 and West German Patent No. 1,957,467.

(4) A method of dissolving the compound in a water-miscible solvent and gradually adding an aqueous latex to the solution to form a dispersion wherein the latex particles contain the compound. This method is described in, for example, Japanese Patent Application (OPI) No. 59943/76.

Furthermore, the hydrosol of oleophilic polymer described in Japanese Patent Publication No. 39853/76 may be added to the dispersion of hydrophilic colloid obtained as described above, in an amount of 1 to 20 times, preferably 4 to 10 times the weight quantity of the coloring material.

The dispersion of the azo compound of this invention and the coloring materials as described below can be greatly promoted by using a surface active agent as an emulsification aid in an amount of 1/100 to 1/5 times the weight quantity of the coloring material. Examples of a surface active agent which is used for the purpose are described in, for example, Japanese Patent Publication No. 4923/64 and U.S. Pat. No. 3,676,141.

The typical hydrophilic colloid which is used for dispersing the azo compound of this invention or the coloring material is gelatin and a part or the whole of gelatin may be replaced with a synthetic hydrophilic colloid.

Specific examples of the synthetic hydrophilic colloids which can be used in this invention in place of gelatin are described in, for example, West German Patent Application (OLS) No. 2,312,708; U.S. Pat. Nos. 3,620,751 and 3,879,205; Japanese Patent Publication No. 7561/78.

There is no particular restriction on the support for use of the photographic material of this invention if the support has good dimensional stability. A polyester support having poor oxygen permeability, for example, a polyethylene series or polycarbonate series support, in particular, a polyethylene terephthalate support is preferred.

There is no particular restriction on the internal latent image-type direct positive silver halide emulsions for use in this invention and conventionally known internal latent image-type direct positive silver halide emulsions can be used. For example, a so-called "conversion type" silver halide emulsion prepared by utilizing a difference in solubility of silver halides and a so-called "core/shell-type" silver halide emulsion composed of the inner core of silver halide which is doped with a metal ion or chemically sensitized, or is subjected to both the treatment and the outer shell covering at least the photosensitive site of the aforesaid inner core can be used. Among these emulsions, the core/shell type silver halide emulsion is preferred.

For doping the core of the core/shell silver halide grains for use in this invention with a metal ion, the formation or the physical ripening of the silver halide grains for the core is performed in the presence of a metal ion source such as a cadmium salt, a zinc salt, a lead salt, a thalium salt, an iridium salt or a complex salt thereof, a rhodium salt or a complex salt thereof, an iron salt of a complex salt thereof, etc. The metal ion is usually used in an amount of more than $10^{-6}$ mole per mole of silver halide. The siler halide for the core may be chemically sensitized using at least one of a noble metal sensitizer, a sulfur sensitizer, and a reduction sensitizer in place of or together with the doping with a metal ion described above. In particular, the application of both metal sensitization and sulfur sensitization can effectively increase the sensitivity. Such a treatment of the silver halide for the core and a manner of covering a silver halide for the shell on the surface of the silver halide grains constituting the core are known and the methods described in, for example, U.S. Pat. Nos. 3,206,316; 3,317,322; 3,367,778 (excluding a fogging step of the grain surface); 3,761,276, etc., can be advantageously employed.

The ratio of the silver halide for core and the silver halide for shell can be optionally selected but usually 0.5 to 8 moles of the latter is used per one mole of the former.

It is preferred that the silver halide for the core has a same composition as that of the silver halide for the shell but the composition of the former may differ than that of the latter. As the silver halides for the core and shell, silver bromide, silver iodide, silver chloride, silver chlorobromide, silver bromoiodide, silver chlorobromoiodide, etc., can be used in this invention. A preferred silver halide is composed of at least 50 mole% silver bromide and silver bromide is most preferred for the core and for the shell.

In this invention, core/shell silver halide grains having various grain sizes can be used but core/shell silver halide grains having a mean grain size of about 0.1 to about 2.5 microns, preferably about 0.2 to about 2.5 microns, more preferably about 0.8 to about 2.0 microns give good results.

The core/shell silver halide grains for use in this invention may have a regular crystal form such as a cubic form and an octahedral form, or an irregular crystal form such as a spherical form and a tabular form, or may be a mixed form of these crystal forms or the silver halide grains may be composed of a mixture of these silver halide grains having various crystal forms. Examples of the internal latent image-type core/shell silver halide emulsions having tabular form are described in, for example, European Pat. No. 79583 and British Pat. Nos. 2,111,706A and 2,110,831A.

The core/shell silver halide grains for use in this invention are dispersed in a binder as well known.

As the binder, gelatin is advantageously used but other hydrophilic colloids can be used.

As such a hydrophilic colloid, there are, for example, gelatin derivatives, graft polymers of gelatin and other polymers; proteins such as albumin, casein, etc.; cellulose derivatives such as hydroxyethyl cellulose, carboxymethyl cellulose, cellulose sulfuric acid esters, etc.; sugar derivatives such as sodium alginate, starch derivatives, etc.

As gelatin, lime-processed gelatin as well as acid-processed gelatin, and enzyme-processed gelatin as described in *Bull. Soc. Sci. Photo. Japan;* No. 16, 30(1966) may be used and further the hydrolyzed product or enzyme-decomposed product of gelatin can be used in this invention.

As the gelatin derivatives, the materials obtained by reacting gelatin and various compounds such as acid halides, acid anhydrides, isocyanates, bromoacetic acid, alkanesultones, vinylsulfonamides, maleinimide compounds, polyalkylene oxides, epoxy compounds, etc., can be used.

Specific examples of the gelatin derivatives are described in U.S. Pat. Nos. 2,614,928; 3,132,945; 3,186,846; and 3,312,553; British Pat. Nos. 861,414; 1,033,189; and 1,005,784; Japanese Patent Publication No. 26845/67, etc.

As the gelatin graft polymers for use in this invention, there are products obtained by grafting a homopolymer or a copolymer of a vinylic monomer such as acrylic acid, methacrylic acid, the derivatives thereof such as the esters, amide, etc., of them, acrylonitrile, styrene, etc., to gelatin. In particular, graft polymers of polymers having some compatibility with gelatin, such as polymers of acrylic acid, methacrylic acid, acrylamide, methacrylamide, hydroxyalkyl methacrylate, etc., and gelatin are preferred. Examples of these graft polymers are described in U.S. Pat. Nos. 2,763,625; 2,831,767; 2,956,884, etc.

Specific examples of the synthetic hydrophilic polymers which can be used in this invention in place of gelatin are described in, for example, West German Patent Application (OLS) No. 2,312,708; U.S. Pat. Nos. 3,620,751 and 3,879,205; Japanese Patent Publication No. 7561/78.

Also, the photographic emulsion layers, etc., of the photographic materials of this invention may contain inactive particles (preferably polymer latex) which are substantially non-swellable in an aqueous alkali solution, are compatible with gelatin, and have substantially non-film forming property in order to improve the permeation of processing solution. As the polymer latex, there are latexes of polymers (homopolymers or copolymers) of acrylic acid or methacrylic acid or styrenic polymers (homopolymers or copolymers).

In the photographic silver halide emulsions for use in this invention, it is not always necessary to chemically sensitize the grain surface of the silver halide but the silver halide grain surface may be chemically sensitized to some extent. Also, the photographic silver halide emulsions may be spectrally sensitized by methine dyes, etc.

Typical examples of the hydrazine series nucleating agents which can be used in this invention are the hydrazines described in U.S. Pat. Nos. 2,588,982 and 2,563,785; the hydrazines and hydrazones described in U.S. Pat. No. 3,227,552; the sensitizing dyes having a nucleating substituent in the dye molecule described in U.S. Pat. No. 3,718,470; the thiourea combined type acylhydrazine compounds described in U.S. Pat. Nos. 4,030,925; 4,031,127; 4,245,037; 4,255,511; 4,266,013; 4,276,364; British Patent No. 2,012,443, etc.; the urea-type acylhydrazine compounds described in U.S. Pat. No. 4,374,923; the acylhydrazine compounds having bonded thereto a thioamido ring or a heterocyclic ring such as triazole, tetrazole, etc., as an adsorbing group described in U.S. Pat. Nos. 4,080,270; 4,278,748; British Patent No. 2,011,391B, etc.

It is preferred that the amount of the nucleating agent is that for giving the sufficient maximum density in the case of developing the photographic silver halide emulsions of this invention with a surface developer. Practically, the amount differs according to the characters of the silver halide emulsions to be used, the chemical structure of the nucleating agent, and the development conditions and hence the proper content of the nucleating agent can be changed in a wide range but is usually about 0.1 mg to about 5 g, preferably about 0.5 mg to about 2 g per mole of silver in the photographic silver halide emulsion.

The photographic materials of this invention can be used for a black-and-white photographic process or a color photographic process. That is, the photographic materials of this invention can be practically used as photographing photographic materials, printing photographic materials, graphic art photographic materials, X-ray photographic materials, photographic materials for microphotography, diffusion transfer photographic materials, heat development-type photographic materials, silver dye bleaching photographic materials, motion picture photographic materials, etc., and the photographic materials of this invention can be utilized in a wide field.

When the photographic materials of this invention are used for color photography, various coloring materials can be used for the photographic materials. One of the most typical examples of the coloring materials is a coupler. It is preferred that the coupler is a non-diffusible coupler having a hydrophobic group called as ballast group in the molecule. The coupler may be four-equivalent or two-equivalent to a silver ion. Also, the photographic materials of this invention may contain colored couplers having a color correction effect or so-called DIR couplers, i.e., the couplers releasing a development inhibitor with the progress of development. The couplers may be couplers capable of giving colorless products upon the coupling reaction.

In this invention, as a yellow coloring coupler, known open chain ketomethylene couplers can be used.

Among these couplers, benzoylacetanilide series and pivaloylacetonitrile series compounds are useful.

As a magenta coloring coupler, pyrazolone series compounds, indazolone series compounds, cyanoacetyl compounds, etc., can be used. In particular, pyrazolone series compounds are advantageously used. Also, pyrazolotriazole series compounds, pyrazoloimidazole series compounds, pyrazolopyrazole series compounds, etc., are also advantageously used.

As a cyan coupler, phenolic compounds, naphtholic compounds, etc., can be used in this invention.

Also, the photographic materials of this invention can be used together with colored couplers, DIR couplers (DIR couplers releasing a development inhibitor having particularly high diffusibility), etc.

The photographic materials of this invention may further contain compounds releasing a development inhibitor with development in addition with the DIR couplers. Examples of the DIR compounds for use in this invention are described in, for example, U.S. Pat. Nos. 3,297,445; 3,379,529; West German Patent Application (OLS) No. 2,417,914; Japanese Patent Application (OPI) Nos. 15271/77; 9116/78, etc.

Two or more kinds of couplers may be incorporated in a same layer or a same compound may be incorporated in two or more layers.

The coupler is generally incorporated in a silver halide emulsion layer in an amount of $2\times10^{-3}$ mole to $5\times10^{-1}$ mole, preferably $1\times10^{-2}$ mole to $5\times10^{-1}$ mole per mole of silver in the silver halide emulsion layer.

Also, in the case of applying the photographic materials of this invention for a color diffusion transfer process, dye developing agents can be used as the coloring materials but it is advantageous to use a coloring material which is non-diffusible (immobile) in an alkaline developer as itself but releases a diffusible dye (or a precursor thereof) as the result of development. As the diffusible dye-releasing coloring materials, there are couplers and redox compounds releasing a diffusible dye and these couplers or compounds are useful not only for color diffusion transfer process (wet system) but also as coloring materials for heat development type photographic materials (dry system) as described in, for example, Japanese Patent Application (OPI) No. 58543/83.

The diffusible dye-releasing redox compounds (hereinafter, is referred to an "DRR compound") can be expressed by the following general formula (Ballast) (redox cleavage atom group—D wherein (Ballast) and (redox cleavage atomic group) have the same significance as explained about $Y_1$ and $Y_2$ of general formula (I) and D represents a dye (or a precursor thereof) moiety.

The dye moiety may be combined with a redox cleavage atomic group through a linkage group. The dye moieties shown by D in the foregoing formula, which are effectively used in this invention are those described in the following publications.

Examples of yellow dyes are described in U.S. Pat. Nos. 3,597,200; 3,309,199; 4,013,633; 4,245,028; 4,156,609; 4,139,383; 4,195,992; 4,148,641; 4,148,643; 4,336,322; Japanese Patent Application (OPI) Nos. 114930/76; 71072/81; *Research Disclosure,* No. 17630(1978), ibid., No. 16475(1977).

Examples of the magenta dye are described in U.S. Pat. Nos. 3,453,107; 3,544,545; 3,932,380; 3,931,144; 3,932,308; 3,954,476; 4,233,237; 4,255,509; 4,250,246; 4,142,891; 4,207,104; 4,287,292; Japanese Patent Application (OPI) Nos. 106727/77; 23628/78; 36804/80; 73057/81; 71060/81; and 134/80.

Examples of the cyan dye are described in U.S. Pat. Nos. 3,482,972; 3,929,760; 4,013,635; 4,268,625; 4,171,220; 4,242,435; 4,142,891; 4,195,994; 4,147,544; 4,148,642; British Patent No. 1,551,138; Japanese Patent Application (OPI) Nos. 99431/79; 8827/77; 47823/78; 143323/78; 99431/79; 71061/81; European Patent (EPC) Nos. 53,037 and 53,040; *Research Disclosure,* No. 17630(1978), ibid., No. 16475(1977).

The coating amount of these compounds are generally about $1\times10^{-4}$ to about $1\times10^{-2}$ mole/m$^2$, preferably about $2\times10^{-4}$ to about $2\times10^{-2}$ mole/m$^2$.

The coloring material for use in this invention may incorporated in a silver halide emulsion layer associated therewith or may be incorporated in a layer adjacent to the silver halide emulsion layer, which adjacent layer may be positioned at closer to the support than the silver halide emulsion layer or at more remote from the support than the silver halide emulsion layer, provided that exposure to light is generally carried out from more remote side from support than the silver halide emulsion layer.

In the case of using DRR compounds as the coloring materials of this invention, any silver halide developing agents (or electron doners) capable of cross-oxidizing the compounds can be used. Among these compounds, 3-pyrazolidones are preferred.

In the case of using the photographic materials of this invention for a diffusion transfer film unit, it is preferred to process the photographic materials with a viscous developer. The viscous developer is a liquid composition containing the processing components necessary for the development of silver halide emulsions (and the formation of diffusion transfer dye images). The main solvent is water and the developer may, as the case may be, contain a hydrophilic solvent such as methanol, methylcellosolve, etc. It is preferred that the processing composition contains a hydrophilic polymer such as polyvinyl alcohol having a high molecular weight, hydroxyethyl cellulose, sodium carboxymethyl cellulose, etc. These polymers are used so that a viscosity of higher than 1 poise, preferably 500–1000 poise of the processing composition at room temperature is achieved.

It is preferred that the aforesaid processing composition is packed in a rupturable container by pressure as described in U.S. Pat. Nos. 2,543,181; 2,643,886; 2,653,732; 2,723,051; 3,056,491; 3,056,492; 3,152,515, etc.

In the case of using the photographic materials of this invention for a color diffusion transfer process, the photographic silver halide emulsions may be coated on a support having also coated thereon an image-receiving layer in an integrated form or may be coated on a support different from the support of an image-receiving element. Also, silver halide photographic emulsion layers (light-sensitive element and an image-receiving layer (image-receiving element) may be provided in a combined form as a film unit or may be separate photographic materials. Also, the film unit may be an integrated form throughout the light-exposure, development, and appreciation of the transferred images or may be a type that these element are separated from each other after development. This invention is, however, more effectively applied to the latter type.

The following examples are intended to illustrate the present invention but not to limit it in any way.

EXAMPLE 1

A light-sensitive sheet was prepared by coating, in succession, the following layers (1) to (11) on a black support.

(1) A layer containing 0.36 millimole /m$^2$ of the cyan DRR compound having the formula shown below, 0.09 g/m$^2$ of tricyclohexyl phosphate, 0.01 g/m$^2$ of 2,5-di(t-pentadecyl)hydroquinone, and 0.44 g/m$^2$ of gelatin.

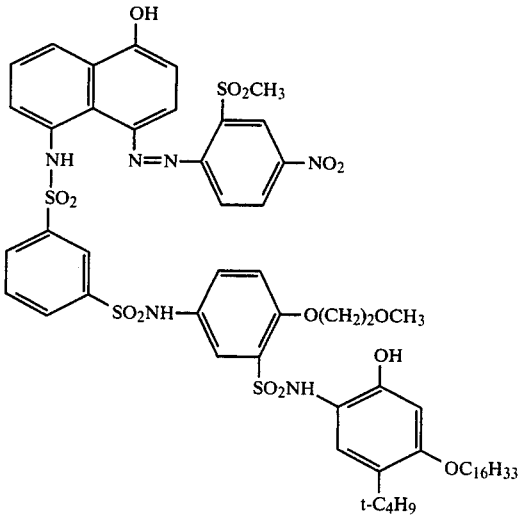

(2) A layer containing 0.5 g/m$^2$ (as the amount of silver) of a red-sensitive internal latent image-type direct reversal-type silver bromide emulsion, 0.78 g/m$^2$ of gelatin, 2.7 μg/m$^2$ of the nucleating agent having the formula shown below, and 0.06 g/m$^2$ of sodium pentadecylhydroquinonesulfonate.

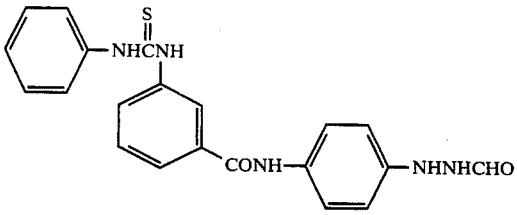

(3) A layer containing 0.71 g/m$^2$ of 2,5-di(tertpentadecyl)hydroquinone, 0.24 g/m$^2$ of a copolymer of vinylpyrrolidone and vinyl acetate (7:3 by mole ratio), and 0.4 g/m$^2$ of gelatin.

(4) A layer containing 0.3 g/m$^2$ of gelatin.

(5) A layer containing 0.49 g/m$^2$ of the magenta DRR compound having the formula described below, 0.08 g/m$^2$ of tricyclohexyl phosphate, 0.01 g/m$^2$ of 2,5-di(-tert-pentadecyl)hydroquinone, and 0.5 g/m$^2$ of gelatin.

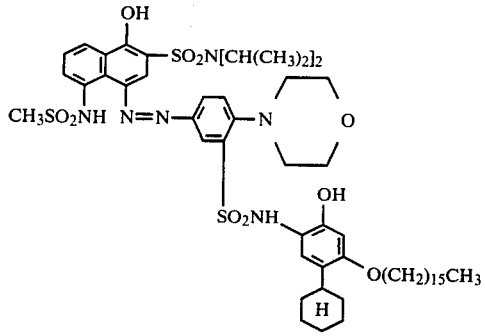

(6) A layer containing 0.34 g/m$^2$ (as the amount of silver) of a green-sensitive internal latent image-type direct reversal silver bromide emulsion, 12.9 μg/m$^2$ of the nucleating agent as in layer (2), 0.66 g/m$^2$ of gelatin, 0.04 g/m$^2$ of sodium pentadecylhydroquinonesulfonate.

(7) A layer containing 0.71 g/m$^2$ of 2,5-di(tertpentadecyl)hydroquinone, 0.24 g/m$^2$ of a copolymer of vinylpyrrolidone and vinyl acetate (7:3 by mole ratio), and 0.4 g/m$^2$ of gelatin.

(8) A layer containing 0.25 g/m$^2$ of gelatin.

(9) A layer containing 0.48 g/m$^2$ of the yellow DRR compound having the formula shown below, 0.03 g/m$^2$ of tricyclohexyl phosphate, 0.004 g/m$^2$ of 2,5-di(tert-pentadecyl)hydroquinone, and 0.43 g/m$^2$ of gelatin.

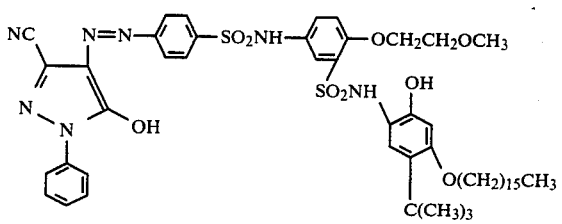

(10) A layer containing 0.84 g/m$^2$ (as the amount of silver) of a blue-sensitive material internal latent image-type direct reversal silver bromide emulsion, 0.9 g/m$^2$ of gelatin, 29 mg/m$^2$ of the nucleating agent as in layer (2), and 1.0 g/m$^2$ of sodium pentadecylhydroquinonesulfonate.

(11) A layer containing 1.0 g/m$^2$ of gelatin.

Apart from this, 0.8 g of a processing liquid having the composition below was packed in a rupturable container.

Processing Liquid:

Benzyl Alcohol: 0.20 ml
1-(p-Tolyl)-4-hydroxymethyl-4-methyl-3-pyrazolizinone: 0.3 g
Methylhydroquinone: 0.012 g
5-Methylbenzotriazole: 0.6 g
Sodium Sulfite: 0.18 g
Hydroxymethyl Cellulose: 4 g
Sodium Hydroxide (28% aq. soln.): 22.4 ml
Water: 67 ml Also, a dye image-receiving sheet was prepared by successively coating the following layers (12) to (16) on a white support having a carbon black layer and a titanium white layer successively coated on the back surface thereof.

(12) A layer containing 22 g/m$^2$ of a copolymer of acrylic acid and butyl acrylate (80:20 by weight ratio) and 0.44 g/m$^2$ of 1,4-bis(2,3-epoxypropoxy)butane.

(13) A layer containing 3.8 g/m$^2$ of acetyl cellulose (forming 39.4 g of acetyl group by the hydrolysis of 100 g of acetyl cellulose), 0.2 g/m$^2$ of a copolymer of styrene and maleic anhydride (60:40 by weight ratio) having a molecular weight of about 50,000, and 0.115 g/m$^2$ of 5-(β-cyanoethylthio)-1-phenyltetrazole.

(14) A layer containing 2.5 g/m$^2$ of a copolymer latex of vinylidene chloride, methyl acrylate, and acrylic acid (85:12:3 by weight ratio) and 0.05 g/m$^2$ of a polymethyl methacrylate latex (particles size of 1 to 3 microns).

(15) A mordant layer containing 3.0 g/m$^2$ of the mordant having the formula shown below and 3.0 g/m$^2$ of gelatin.

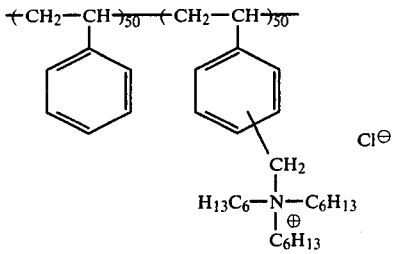

(16) A layer containing 1 g/m$^2$ of phthalated gelatin.

The above-described light-sensitive sheet was denoted as Sample A. Also, Samples B, C and D were prepared by incorporating 11 μmole/m$^2$ of each of Compounds 1, 8, and 10 in layer (1) thereof.

After light-exposing each of samples A, B, C and D, the sample was superposed on the above-described dye image-receiving sheet and the aforesaid processing liquid was spread between then at a thickness of 60 μm by means of pressure-applying members, whereby transferred color images were obtained.

The sensitometric results obtained are shown in Table 1.

TABLE 1

| Sample | Additive to Layer (1) | Red Density Dmax | Red Density Dmin | Green Density Dmax | Green Density Dmin | Blue Density Dmax | Blue Density Dmin |
|---|---|---|---|---|---|---|---|
| Sample A | — (Comparison) | 2.20 | 0.170 | 2.50 | 0.150 | 2.35 | 0.130 |
| Sample B | Compound 1 | 2.50 | 0.175 | 2.50 | 0.150 | 2.35 | 0.130 |
| Sample C | Compound 10 | 2.60 | 0.170 | 2.49 | 0.150 | 2.35 | 0.130 |
| Sample D | Compound 18 | 2.77 | 0.175 | 2.50 | 0.150 | 2.35 | 0.130 |

As shown in the above table, it can be seen that the maximum density of the red-sensitive emulsion layer (Red Density) is largely improved by the addition of the compound of this invention.

EXAMPLE 2

Sample E having the same structure as Sample A in Example 1 except that layer (1') containing 0.4 g/m$^2$ of gelatin was formed between layer (1) and layer (2), was prepared and also Samples F, G and H having the same structure as Sample E except that layer (1') contained 11 μmoles/m$^2$ of Compounds 10, 17 and 18, respectively were prepared.

After uniformly light-exposing each of Samples E, F, G and H so that the transferred density became almost 1, each sample was superposed on the dye image-receiving sheet as described in Example 1 and the processing liquid as in Example 1 was spread between them at a thickness of 60 μm by pressure-applying means.

In Sample E, the density of the transferred dyes was greatly uneven, while in Samples F, G, and H using Compound 10, 17, and 18, respectively, according to this invention, uniform transferred images could be obtained.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photographic material comprising a support having thereon at least an internal latent image direct positive silver halide emulsion layer containing a hydrazine nucleating agent, wherein said silver halide emulsion layer or a layer adjacent to the silver halide emulsion layer contains a non-dye image-forming compound represented by following general formula (I) in an amount sufficient for accelerating nucleation;

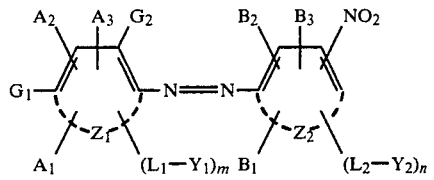

(I)

wherein $Z_1$ and $Z_2$, which may be the same or different, each represents an atomic group necessary for forming a benzene ring or a naphthalene ring; $G_1$ and $G_2$, which may be the same or different, each represents hydrogen or a substituent which does not adversely influence the image; $A_1$, $A_2$ and $A_3$, which may be the same or different, each represents hydrogen or a substituent which does not adversely influence the image; $B_1$, $B_2$ and $B_3$, which may be the same or different, each represents hydrogen or a substituent which does not adversely influence the image; $L_1$ and $L_2$, which may be the same or different, each represents a linkage group; m and n represent 0 or 1; and $Y_1$ and $Y_2$, which may be the same or different, each represents a hydrogen atom or a component having a function of releasing an azo compound from general formula (I) as the result of development wherein said non-dye image-forming compound represented by general formula (I) is employed in an amount of from 0.0005 to 0.1 millimole/m$^2$, and wherein when only one of $G_1$ and $G_2$ is the electron attractive atom or group, the other one represents hydrogen, a halogen atom, an alkyl group, an alkoxy group, a cyano group, a nitro group, $-SO_2R^1$ (wherein $R^1$ represents an alkyl group, a substituted alkyl group, a phenyl group, a substituted phenyl group, an aralkyl group, or a substituted aralkyl group), $-NHCOR^1$ (wherein $R^1$ is as defined above), $-NHSO_2R^1$ (wherein $R^1$ is as defined above),

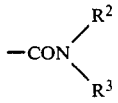

(wherein $R^2$ and $R^3$, which may be the same or different, each represents hydrogen, an alkyl group, a substituted alkyl group, a phenyl group, a substituted phenyl group, an aralkyl group, a substituted aralkyl group, or

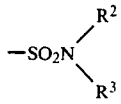

(wherein $R^2$ and $R^3$ are as defined above).

2. The direct positive silver halide photographic material as claimed in claim 1, wherein said non-dye image-forming compound represented by general formula (I) is contained in said layer adjacent to the silver halide emulsion layer.

3. The direct positive silver halide photographic material as claimed in claim 1, wherein said non-dye image-forming compound represented by general formula (I) is employed in an amount of from 0.004 to 0.02 millimole/$m^2$.

4. The direct positive silver halide photographic material as claimed in claim 1, wherein said non-dye image-forming compound represented by general formula (I) is employed in an amount of from 0.001 to 0.05 millimole/$m^2$.

5. The direct positive silver halide photographic material as claimed in claim 1, wherein said nucleating agent is employed in an amount of from 0.1 mg to 5 g per mole of silver in the silver halide emulsion layer.

6. The direct positive silver halide photographic material as claimed in claim 5, wherein said nucleating agent is employed in an amount of from 0.5 mg to 2 g per mole of silver in the silver halide emulsion layer.

7. The direct positive silver halide photographic material as claimed in claim 1, wherein the substituent which does not adversely influence the image which can be employed for $G_1$, $G_2$, $A_1$, $A_2$, $A_3$, $B_1$, $B_2$, and $B_3$ is selected from the group consisting of a halogen atom, a nitro group, a cyano group, an alkyl group, a substituted alkyl group, an alkoxy group, a substituted alkoxy group, a group shown by $—NHCOR^1$ (wherein $R^1$ represents an alkyl group, a substituted alkyl group, a phenyl group, a substituted phenyl group, an aralkyl group, or a substituted aralkyl group), a group represented by $—NHSO_2R^1$ (wherein $R^1$ is as defined above), a group shown by $—SOR^1$ (wherein $R^1$ is as defined above), a group shown by $—SO_2R^1$ (wherein $R^1$ is as defined above), a group shown by $—COR^1$ (wherein $R^1$ is as defined above), a group shown by

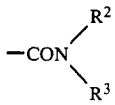

(wherein $R^2$ and $R^3$, which may be the same or different, each represents hydrogen, an alkyl group, a substituted alkyl group, a phenyl group, a substituted phenyl group, an aralkyl group, or a substituted aralkyl group)), a group shown by

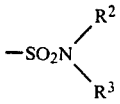

(wherein $R^2$ and $R^3$ are as defined above), an amino group which may be substituted by an alkyl group and a group forming a hydroxy group by hydrolysis.

8. The direct positive silver halide photographic material as claimed in claim 1, wherein said linkage group shown by $L_1$ and $L_2$ is represented by $—J_1—X_2—J_2—X_2)_p—J_3—X_3)_q$ wherein $J_1$, $J_2$ and $J_3$, which may be the same or different, each represents —CO—, $—SO_2—$,

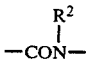

(wherein $R^2$ is as defined above),

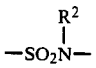

(wherein $R^2$ is as defined above),

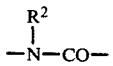

(wherein $R^2$ is as defined above),

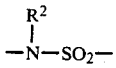

(wherein $R^2$ is as defined above),

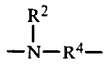

(wherein $R^2$ is as defined above and $R^4$ represents an alkylene group having 1 to about 4 carbon atoms),

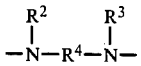

(wherein $R^2$, $R^3$, and $R^4$ are as defined above), —O—, —S—,

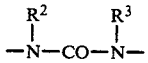

(wherein $R^2$ and $R^3$ are as defined above),

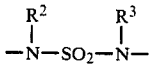

(wherein $R^2$ and $R^3$ are as defined above); $X_1$, $X_2$ and $X_3$, which may be the same or different, each represents an alkylene group, a substituted alkylene group, an arylene group, a substituted arylene group, an aralkylene group, or a substituted aralkylene group and p, q and r in the above formula each represent 0 to 1.

9. The direct positive silver halide photographic material as claimed in claim 1, wherein $Y_1$ and $Y_2$ are each represented by the group shown by (Ballast) (Redox cleavage atomic group—wherein (Ballast—is a group substantially immobilizing the compound of general formula (I) in photographic layers and—Redox cleavage atomic group—has the property of being cleaved by oxidation or reduction by the action of heat or under an alkaline condition or a property of ring-closure to release the azo compound portion bonded thereto.

10. The direct positive silver halide photographic material as claimed in claim 7, wherein the substituent of said substituted alkyl group, substituted alkoxy group, substituted phenyl group and substituted aralkyl group is selected from the group consisting of an amino group, hydroxy group, nitro group, an alkoxy group having 1–4 carbon atoms, a group shown by $—NHSO_2R^1$ (wherein $R^1$ represents an alkyl group, a substituted alkyl group, a phenyl group, a substituted phenyl group, an aralkyl group, or a substituted aralkyl group), a group shown by $—NHCOR^1$ (wherein $R^1$ is as defined above), a group shown by

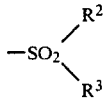

(wherein $R^2$ and $R^3$ are as defined below), a group shown by

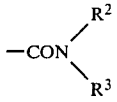

(wherein $R^2$ and $R^3$, which may be the same or different, each represents hydrogen, an alkyl group, a substituted alkyl group, a phenyl group, a substituted phenyl group, an aralkyl group, or a substituted aralkyl group), a group shown by $—SO_2R^1$ (wherein $R^1$ is as defined above), a group shown by $—COR^1$ (wherein $R^1$ is as defined above), a halogen atom, a cyano group, and an amino group, which may be substituted by an alkyl group.

11. The direct positive silver halide photographic material as claimed in claim 1, wherein at least one of $G_1$ and $G_2$ represents an electron attractive atom or group having a Hammet's $\sigma$ value higher than that of a fluorine atom.

12. The direct positive silver halide photographic material as claimed in claim 11, wherein the electron attractive atom or group represents a fluorine atom, a chlorine atom, a bromine atom, an iodine atom, a nitro group, a cyano group, an alkylsulfonyl group, a sulfamoyl group, a sulfonamido group or a carbamoyl group.

13. The direct positive silver halide photographic material as claimed in claim 1, wherein $A^1$, $A^2$ and $A^3$, which may be the same or different, each represents hydrogen, an alkyl group, a halogen atom, a cyano group, $—NHCOR^1$ (wherein $R^1$ represents an alkyl group, a substituted alkyl group, a phenyl group, a substituted phenyl group, an aralkyl group, or a substituted aralkyl group), $—NHSO_2R^1$ (wherein $R^1$ is as defined above), $—SO_2R^1$ (wherein $R^1$ is as defined above),

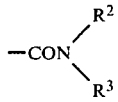

(wherein $R^2$ and $R^3$, which may be the same or different, each represents hydrogen, an alkyl group, a substituted alkyl group, a phenyl group, a substituted phenyl group, an aralkyl group, or a substituted aralkyl group), or

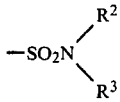

($R^2$ and $R^3$ are as defined above).

14. The direct positive silver halide photographic material as claimed in claim 1, wherein $B_1$, $B_2$, and $B_3$, which may be the same or different, each represents hydrogen, a halogen atom, a nitro group, a cyano group, an alkyl group, an alkoxy group, $—SO_2R^1$ (wherein $R^1$ represents an alkyl group, a substituted alkyl group, a phenyl group, a substituted phenyl group, an aralkyl group, or a substituted aralkyl group),

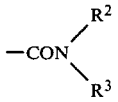

(wherein $R^2$ and $R^3$, which may be the same or different, each represents hydrogen, an alkyl group, a substituted alkyl group, a phenyl group, a substituted phenyl group, an aralkyl group, or a substituted aralkyl group), or

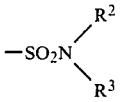

(wherein $R^2$ and $R^3$ are as defined above).

15. The direct positive silver halide photographic material as claimed in claim 8, wherein $J_1$, $J_2$ and $J_3$, which may be the same or different, each represents —CO—, $—SO_2—$, —CONH—, $—SO_2NH—$, —NHCO—, or $—NHSO_2—$.

16. The direct positive silver halide photographic material as claimed in claim 8, wherein $X_1$, $X_2$, and $X_3$, which may be the same or different, each represents an alkylene group, an arylene group or a substituted arylene group.

17. The direct positive silver halide photographic material as claimed in claim 8, wherein p, q and r represent 0 or 1.

18. The direct positive silver halide photographic material as claimed in claim 1, wherein $Z_1$ represents an atomic group necessary for forming a benzene ring or a naphthalene ring and $Z_2$ represents an atomic group necessary for forming a benzene ring.

19. The direct positive silver halide photographic material as claimed in claim 1, wherein at least one of $G_1$ and $G_2$ is a halogen atom.

20. The direct positive silver halide photographic material as claimed in claim 19, wherein when only one of $G_1$ and $G_2$ is a halogen atom, the other one is hydrogen, an alkyl group or an alkoxy group.

21. The direct positive silver halide photographic material as claimed in claim 1, wherein $A_1$, $A_2$, and $A_3$, which may be the same or different, each represents hydrogen a halogen atom, an alkyl group, a cyano group, $—NHCOR^5$ (wherein $R^5$ represents an alkyl group or a phenyl group), $—NHSO_2R^5$ (wherein $R^5$ is as defined above),

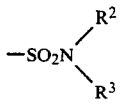

(wherein $R^2$ and $R^3$, which may be the same or different, each represents hydrogen, an alkyl group, a substituted alkyl group, a phenyl group, a substituted phenyl group, an aralkyl group, or a substituted aralkyl group), or

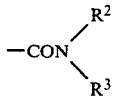

(wherein $R^2$ and $R^3$ are as defined above).

22. The direct positive silver halide photographic material as claimed in claim 1, wherein $B_1$, $B_2$, and $B_3$, which may be the same or different, each represents hydrogen, a cyano group, a halogen atom, a nitro group, an alkyl group, $—SO_2R^5$ (wherein $R^5$ represents an alkyl group or a phenyl group),

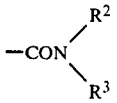

(wherein $R^2$ and $R^3$, which may be the same or different, each represents hydrogen, an alkyl group, a substituted alkyl group, a phenyl group, a substituted phenyl group, an aralkyl group, or a substituted aralkyl group), or

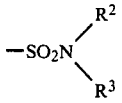

(wherein $R^2$ and $R^3$ are as defined above).

23. The direct positive silver halide photographic material as claimed in claim 8, wherein $J_1$ and $J_2$, which may be the same or different, each represents —CO—, $—SO_2—$, —CONH—, $—SO_2NH—$, —NHCO—, or $—NHSO_2—$.

24. The direct positive silver halide photographic material as claimed in claim 8, wherein $X_1$ and $X_2$, which may be the same or different, each represents a phenylene group, a substituted phenylene group or an alkylene group.

25. The direct positive silver halide photographic material as claimed in claim 8, wherein p and r represent 0 or 1 and q represents 0.

26. The direct positive silver halide photographic material as claimed in claim 7, wherein the nitro group substituted to the benzene ring completed by $Z_1$ and $Z_2$ is disposed at the p-position or the o-position to an azo group.

* * * * *